US009739030B1

(12) United States Patent
Sova

(10) Patent No.: US 9,739,030 B1
(45) Date of Patent: Aug. 22, 2017

(54) EXCAVATOR OPERATOR COMPARTMENT BETWEEN TWO BOOMS

(71) Applicant: Emery J. Sova, Midland, MI (US)

(72) Inventor: Emery J. Sova, Midland, MI (US)

( * ) Notice: Subject to any disclaimer, the term of this patent is extended or adjusted under 35 U.S.C. 154(b) by 12 days.

(21) Appl. No.: 14/864,266

(22) Filed: Sep. 24, 2015

(51) Int. Cl.
*E02F 3/42* (2006.01)
*E02F 3/32* (2006.01)

(52) U.S. Cl.
CPC ..... *E02F 3/32* (2013.01); *E02F 3/427* (2013.01)

(58) Field of Classification Search
None
See application file for complete search history.

(56) References Cited

U.S. PATENT DOCUMENTS 3,902,295 A * 9/1975 Yancey ..... E02F 3/38 37/379

4,049,139 A * 9/1977 Stedman ..... E02F 3/303 414/694

* cited by examiner

*Primary Examiner* — Scott Lowe
*Assistant Examiner* — Ronald Jarrett
(74) *Attorney, Agent, or Firm* — Robert L. Farris

(57) ABSTRACT

An undercarriage frame is supported by driven tracks. An upper frame is pivotally connected to the carriage frame for pivotal movement about a vertical axis. Left and right booms are attached to the carriage frame for pivotal movement about a horizontal axis. The operator's enclosure is mounted on the carriage frame between rear boom portions. Front portions of the booms are offset toward each other to enter a trench. A forked stick includes a tube coaxial with a stick pivot axis. A stick tine is attached to each end of the tube. A stick portion fixed to the tube between the tines extends away from the tines. Left and right trunnions with center passages are journaled in boom bores and received in the tube. A stick shaft passes through the central passages and fix the trunnions to the tube. Stick and boom cylinders pivot the booms and the stick.

4 Claims, 6 Drawing Sheets

EXCAVATOR OPERATOR COMPARTMENT BETWEEN TWO BOOMS

TECHNICAL FIELD

The invention relates to a large hydraulic excavators with improved operator visibility during excavation of deep trenches.

BACKGROUND OF THE INVENTION

Municipal sewer lines extend from homes, civic facilities and commercial buildings to sewage treatment facilities. The lines have a maximum fluid capacity that exceeds the actual flow leaving space filled with air and other gasses.

Gravity induces flow of fluids and solids in sewer lines. To maintain adequate flow the lines generally have a uniform slope from an inlet pipe end down to an outlet pipe end and no raised areas in the pipe that would hold liquids or solids. The sewer lines are preferably sufficiently deep to receive sewage from basements without the use of sewage pumps.

Potable water lines may be above sewer lines. The water is under pressure and is substantially free of air. However it is desirable for lines to be at controlled elevations to avoid potential problems. These problems include freezing in cold periods, heat expansion in hot periods, and a collection of solids in a low area of a pipe. The collected solids are generally inert sand or scale from the aquifer or water supply pumps and pipes, that are not moved by water flow through the line pipes. The ground surface above sewer lines varies substantially from flat and horizontal in most environments.

An operator sitting in the operator's seat on one side of a boom of a prior art hydraulic excavator can see the bucket on the end of an excavator stick when the bucket first enters a trench. After the bucket moves down into a trench, that is being dug, several feet the operator can only see the bucket by moving his head to a position against a side window and looking along one side of the boom and the stick. The side window is not openable because it is close to the boom and the boom moves relative to the operator's station. As the depth of a trench increases, the portion of a bucket that can be seen from the operator's station decreases. A decreased width of a trench also decrease the operators view of the bucket and the bottom of the trench.

An operator tends to become fatigued in less time when a side of his head is tilted to one side and in contact with an operator's compartment wall.

Trenches are often over twenty five feet deep. With deep trenches there is a possibility of a wall collapse. To protect individuals working in the trench, steel revetment is used. These structures have steel walls connected together near their top edges by two cross beams. With a deep trench an upper revetment structure may sit on top of a lower revetment structure. These revetment structures are referred to as boxes. The walls are normally eight feet high and twenty four feet long. The total weight of one unit is as much as six tons. A light load for an excavator but requires a long reach from the excavator. A box may be anchored if there is a wall collapse. Additional force is required to lift a box from a trench after a wall collapse. Due to their limited height several of the boxes may be stacked together in a trench section that is more than thirty feet deep.

One excavator with a long reach boom that can form a trench which is more than twenty feet deep has a weight of about 112,000 pounds and a 12.5 liter displacement engine. A somewhat larger machine may be required to form a trench that is thirty feet deep at an acceptable rate. Smaller excavators are employed to form a thirty foot deep trench by digging a trench with a width that exceeds the width of the excavator and a depth of five feet or more and then digging a narrow trench that provides the required depth. This two step procedure requires the movement of substantially more material. The two step procedure increases the cost of installing a pipe at the required depth.

SUMMARY OF THE INVENTION

The hydraulic excavator includes an undercarriage frame supported by a left track roller frame assembly and a right track roller frame assembly.

The left track roller frame assembly includes a plurality of left support rollers, a left front idler roller a left rear driven sprocket and at least one left upper track support roller. A left continuous track is trained around a left front idler roller, under the plurality of left support rollers, around a left rear driven sprocket and over the at least one left upper track support roller.

The right track roller frame assembly includes a plurality of right support rollers, a right front idler roller, a right rear driven sprocket, and over the at least one right upper track support roller. A right continuous track is trained around the right front idler roller, under the plurality of right support rollers, around the right rear driven sprocket and over the at least one right upper track support roller.

The left rear driven sprocket is driven by a left hydraulic motor. The right rear driven sprocket is driven by a right hydraulic motor. The left and right track roller frame assemblies may be attached to the undercarriage frame in a fixed position on the left side and a fixed portion of the right side of the undercarriage frame. Undercarriage frame may provide multiple positions for attaching the left track roller frame assembly as well as the right track roller frame assembly.

An upper frame assembly includes a frame plate rotatably attached to the under carriage frame for pivotal movement about a vertical axis. A counter weight is attached to a rear portion of the upper frame assembly. An operator's enclosure, mounted on a forward portion of the upper frame assembly, has side windows, at least one front window and an access door. A housing mounted on the upper frame assembly extends from the counter weight toward the operator's enclosure. The housing has at least one housing service door. The housing encloses an engine that drives one or more hydraulic pumps, valves that direct the flow of hydraulic fluid and valve controllers.

A boom assembly includes a boom shaft journaled on the upper frame assembly for pivotal movement about a horizontal axis that is transverse to the vertical axis. A left boom member includes a left boom portion with a left rear end fixed to the boom shaft, a left free end and a left transition portion between the left rear end and the left free end and integral with the left rear end and the left free end. The left transition portion off sets the left free end to the right of the left rear end. A right boom member includes a right boom portion with a right rear end fixed to the boom shaft, a right free end and a right transition portion between the right rear end and right free end and integral with the right rear end and the right free end. The right transition portion offsets the right free end to the left of the right rear end. The left boom portion with the left rear end is to the left of the operator's enclosure. The right boom portion with the right rear end is to the right of the operator's enclosure.

A stick assembly includes an elongated stick portion with a stick distal end and a stick proximal end. A transverse tube is fixed to the stick proximal end. The transverse tube is coaxial with a stick pivot axis. A left stick tine is fixed to the transverse tube adjacent to a left tube end. A right stick tine is fixed to the transverse tube adjacent to a right tube end. A left female spline, in the transverse tube, is adjacent to the left tube end. A right female spline, in the transverse tube, is adjacent to the right tube end. The left stick tine and the right stick tine extend from transverse tube parallel to each other and away from the stick distal end.

A left trunnion includes a central trunnion passage extending from a trunnion outside end surface to a trunnion inside end surface. A trunnion end flange includes a cylindrical radially outer surface that extends axially relative to the central trunnion passage from the trunnion outside end surface to a radially extending boom retainer surface. A cylindrical bearing surface extends from the trunnion end flange toward the trunnion inside end surface to a radially extending ring shaped surface. A male trunnion spline extends axially between the radially extending ring shaped surface and the trunnion inside end surface.

A right trunnion includes a central trunnion passage extending from a trunnion outside end surface to a trunnion inside end surface. A trunnion end flange including a cylindrical radially outer surface that extends axially relative to the central trunnion passage from the trunnion outside end surface to a radially extending boom retainer surface. A cylindrical bearing surface extends from the trunnion end flange toward the trunnion inside end surface to a radially extending ring shaped surface. A male trunnion spline extends axially between the radially extending ring shaped surface and the trunnion inside end surface.

A stick shaft with a left end, a right end, a shaft diameter that is substantially the same as a diameter of the central trunnion passage in the left trunnion and of the central trunnion passage in the right trunnion. At least one threaded bore in the left end and the right end of the stick shaft. A pair of left shaft side recess extend from the left end of the stick shaft parallel to each other. A pair of right shaft recesses extend from the right end of the stick shaft parallel to each other.

A pair of integral trunnion keys in the central trunnion passage of the left trunnion extend axially from the left trunnion outside end toward the radially extending ring shaped surface.

A pair of integral trunnion keys in the central trunnion passage of the right trunnion extend axially from the right trunnion outside end toward the radially extending ring shaped surface.

The stick shaft passes through the transverse tube of the stick assembly. The left trunnion passes through the left boom bore adjacent to the left free end of the left boom member. The male trunnion spline on the left trunnion engages the left female spline in the left tube end of the transverse tube. The central trunnion passage through the left trunnion passage and the pair of integral trunnion keys of the left trunnion passage receive the left end of the stick shaft and engage the pair of recesses on the left end of the stick shaft. A left retainer plate is clamped to the left end of the stick shaft.

The right trunnion passes through a right boom bore adjacent to the right free end of the right boom member. The male trunnion spline on the right trunnion engages the right female spline in the free end of the stick tube. The central trunnion passage through the right trunnion and the pair of integral trunnion keys of the right trunnion passage engage the pair of recesses on the right end of the stick shaft. A right retainer plate is clamped to the right end of the stick shaft.

A left stick assembly pivot actuator includes a left cylinder end pivotally attached to the left boom member by a left pin and a rod end pivotally attached to the left stick tine. A right stick assembly pivot actuator includes a right cylinder end pivotally attached to right boom member by a right pin and a rod end pivotally attached to the right stick tine.

The stick shaft is coaxial with the stick pivot axis and holds the left trunnion and the right trunnion coaxial with the stick axis.

The splines prevent rotation of the left trunnion and the right trunnion relative to the stick tube. The trunnion keys and stick shaft recesses prevent rotation of the left trunnion relative to the right trunnion.

The reduced diameter of the stick shaft relative to the inside diameter of the tube provides an oil reservoir for lubrication of bearing surfaces between the stick assembly and the left and right booms.

A bucket assembly is pivotally attached to the distal end of the stick. A hydraulic cylinder attached to the elongated stick portion and to the bucket through a linkage assembly pivots the bucket.

BRIEF DESCRIPTION OF DRAWINGS

These and other objects, features and advantages of this invention will become readily apparent in view of the following detailed description of the preferred embodiments and best mode, appended claims and accompanying drawings, in which:

DETAILED DESCRIPTION OF THE PREFERRED EMBODIMENTS

Figure 1:
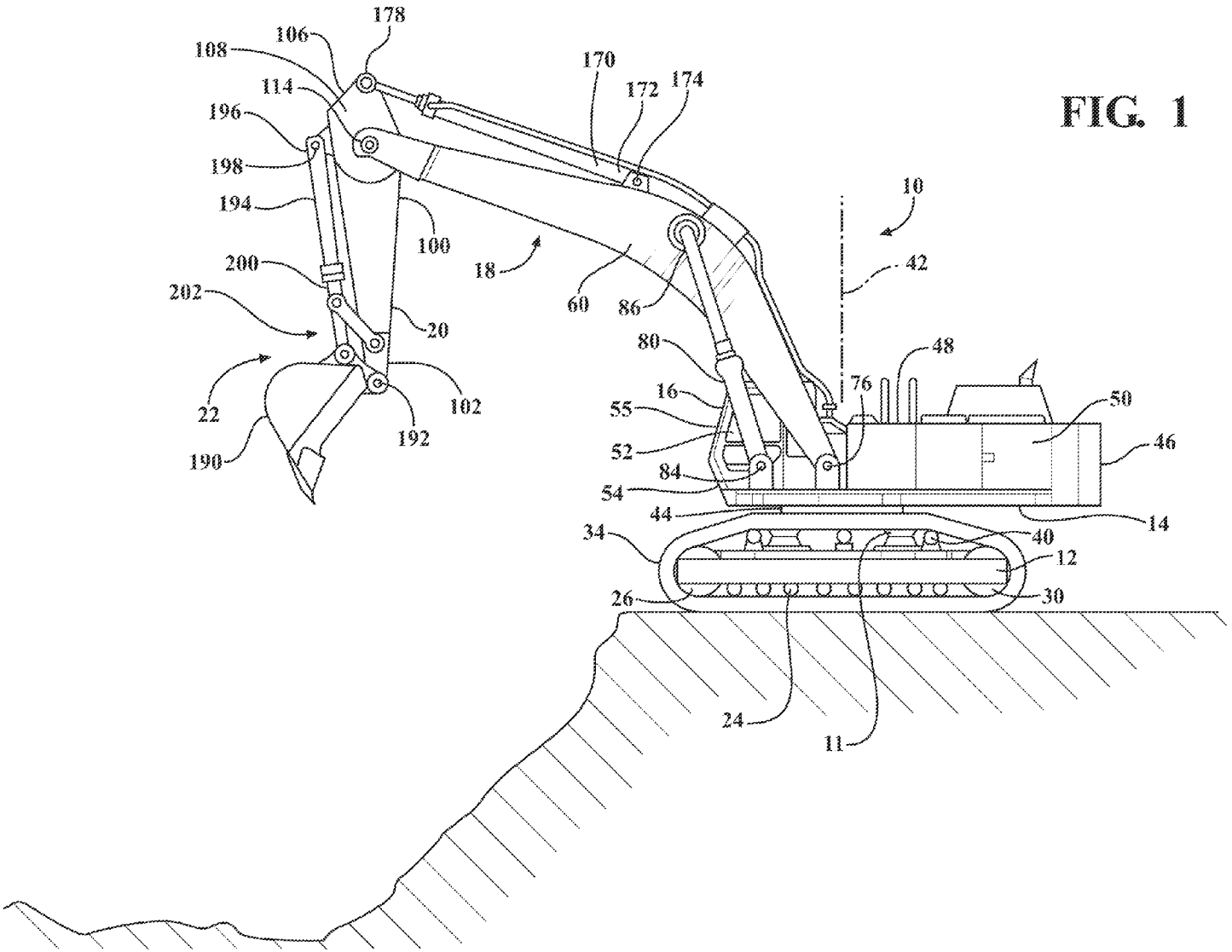
FIG. 1 is a left side elevational view of an excavator with a centered operator's enclosure, two booms, a stick assembly and a bucket.
Figure 2:
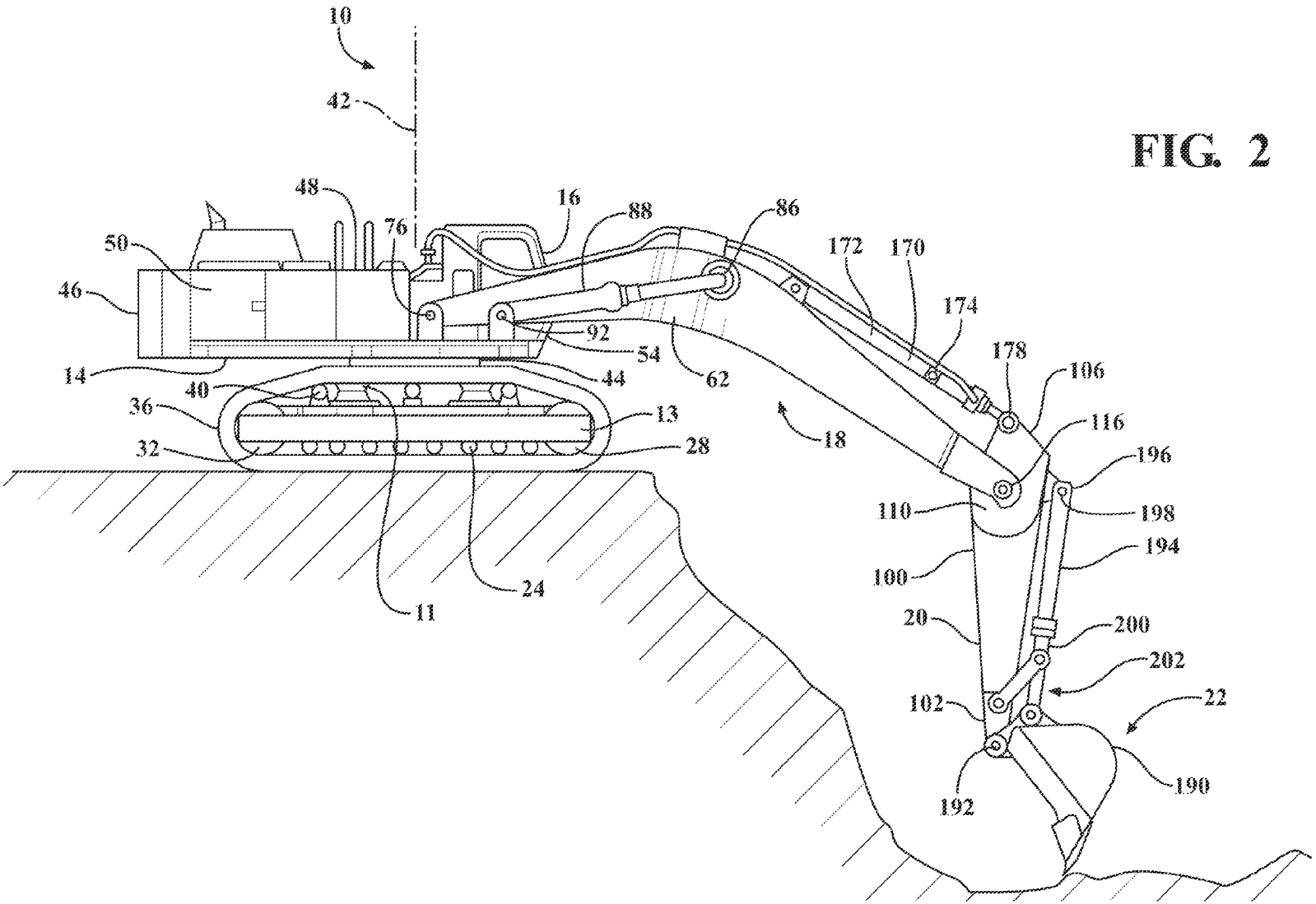
FIG. 2 is a right side elevational view of the excavator.

The terms left and right as well as front and rear are relative to an operator sitting in the operator's enclosure and filling a bucket in a trench.

The hydraulic excavator 10 includes an under carriage frame 11, a left track roller frame 12, a right track roller frame 13, an upper frame 14, a centered operator's enclosure 16, a boom assembly 18, a stick assembly 20 and a bucket assembly 22. The left track roller frame 12 includes a plurality of left support rollers 24. A left front idler roller 26 is journaled on the front left of the left track roller frame 12. The right track roller frame 13 includes a plurality of right support rollers 24. A right front idler roller 32 is journaled on the front right of the right track roller frame 13. A left rear driven sprocket 30 is mounted on the left rear of the track roller frame 12. A right rear driven sprocket 32, that is the same as the left rear driven sprocket 30, is mounted on the right side of the right track roller frame 13. A left continuous track 34 is trained around the left front idler roller 26, under the left support rollers 24 and the left rear driven sprocket 30. A right continuous track 36 is trained around the right front idler roller 28, under the right support rollers 24 and the right rear driven sprocket 32. A plurality of upper track support rollers 40 are journaled on the left track roller frame 12 and the right track roller frame 13 to support an upper run of the left continuous track 34 or the right continuous track 36. The number of upper track support rollers 40 depends on the track length. Different track lengths are available together with appropriate track roller frames 12 and 13.

The upper frame assembly 14 is pivotally attached to the under carriage frame 11 for pivotal movement about a vertical axis 42. A circular plate 44, on the upper frame 14 cooperates with a the under carriage frame 11 to transfer forces through the left track roller frame 12 and the right track roller frame 13 to continuous tracks 34 and 36. Counterweight 46 is mounted on the rear of the upper frame 14. An engine is mounted on the upper frame 14 forward of the weight 46. The engine is enclosed in a housing 48 with openable service doors 50. Hydraulic pumps and control valves are in the housing 48 forward of the engine and near the vertical axis 42.

The centered operator's work enclosure 16 is mounted on the upper frame 14 forward of the vertical axis 42. The enclosure 16 may extend to the rear of the vertical axis 42. It is desirable for the operator to be close to the vertical axis 42. The operator's enclosure 16 provides windows that provide vision forward up, down and to both sides. Vision to the rear is somewhat limited due to the housing 48. However the upper frame 14 can be rotated relative to track roller frame 12 when there is a need to move the excavator 10 to the rear. The side windows 52 are not openable. The front windows 54 are part of a front door 55 that is openable for operator access. When the upper frame 14 is rotated about the vertical axis 42, an operator can step from the enclosure 16 and on to one of the continuous tracks 34 or 36. A rear door (not shown) can be provided on some excavators for an operator to exit or enter the operator's enclosure 16. Sliding side doors (not shown) could also be provided. A sliding side door should be closed during operation of the excavator 10. It is also good practice to lock the boom assembly 18 in a fixed position when leaving the operator's enclosure 16. The boom assembly is locked by sitting the bucket assembly 22 or other attachment on a fixed support surface.

The boom assembly 18 includes a left boom member 60 and a right boom member 62. The left boom member 60 has an end 64 that is secured to a horizontal shaft 76 shown in FIG. 3. The shaft 76 is journaled on the upper frame 14 by bearing supports 65 and 67 and has a shaft horizontal axis 68. The right boom member 62 has an end 66 that is also secured to the horizontal shaft 76. The end 64 of the left boom member 60 and the end 66 of the right boom member 62 are fixed on the shaft member 76 so that both boom members move together when the shaft 76 pivots about the shaft horizontal axis 68. The horizontal axis is transverse to the upper frame 14 and close to the vertical axis 42.

The ends portions of the left boom member 60 and the right boom member 62, that are pivotally attached to the upper frame 14, are generally parallel to each other and spaced apart a distance that exceeds the width of the operator's enclosure 16. The free end portion 70 of the left boom member 60 and the free end portion 72 of the right boom member 62 are closer together than the left end 64 and the right end 66 that are pivotally attached to the upper frame 14 to permit the free end portions 70 and 72 extend into a narrow trench that is being excavated. The free end portions 70 and 72 of the boom members 60 and 62 extend parallel to each other to integral transition portions. A left transition portion 74 of the left boom member 60 is integral with the left end 64 and the left free end portion 70. A right transition portion 78 of the right boom member 62 is integral with the right end 66 and the right free end portion 72. The left transition portion 74 and the right transition portion 78 are located in the boom assembly 18 in positions where they cannot contact the operator's enclosure 16 and generally permit free movement of the left and right free end portions 70 and 72 into a trench that is being excavated.

A left hydraulic cylinder 80 has a cylinder end 82 pivotally attached to the upper frame 14 by a pin 84. A rod end 86 of the hydraulic cylinder 80 is pivotally connected to the left boom member 60. A right hydraulic cylinder 88 has a cylinder end 90 pivotally attached to the upper frame 14 by a pin 92. A rod end 94 of the hydraulic cylinder 88 is pivotally connected to the right boom member 62.

A forked stick assembly 20 includes an elongated stick portion 100 with a bucket assembly 22 on a distal end 102. A transverse tube 104 passes through a proximal end 106 of the elongated stick portion 100 and is fixed to the tube by welding. A left stick tine 108 is attached to the transverse tube 104 adjacent to a left tube end 134 of the transverse tube 104. A right stick tine 110 is attached to the transverse tube 104 adjacent to a right tube end 136 of the transverse tube 104. The left stick tine 108 and the right stick tine 110 may be welded to the transverse tube 104.

Tube female splines 112 are provided in the interior of both ends 134 and 136 of the transverse tube 104. A left trunnion 114 and a right trunnion 116 are substantially identical to each other. Both trunnions 114 and 116 have trunnion splines 118 that engage the female splines 112 in the tube 104. A cylindrical bearing surface 120 on each trunnion extends from the trunnion splines 112 to a trunnion end flange 122. A central trunnion passage 124 extends from the trunnion outside end surface 126 to the trunnion inside end surface 128. Two integral trunnion keys 130 extend radially inward from the central trunnion passage 124 and axially from the trunnion outside end surface 126 toward the trunnion splines 118.

Figure 4:
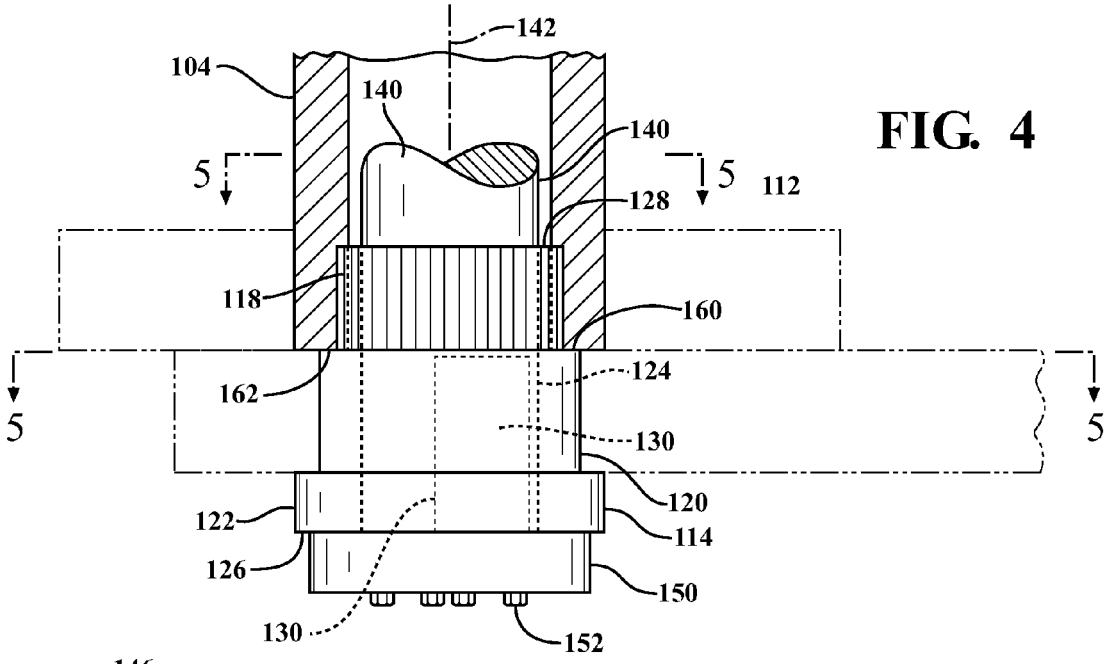
FIG. 4 is an enlarged sectional view with parts broken away showing a trunnion connecting a stick to a boom member.
Figure 5:
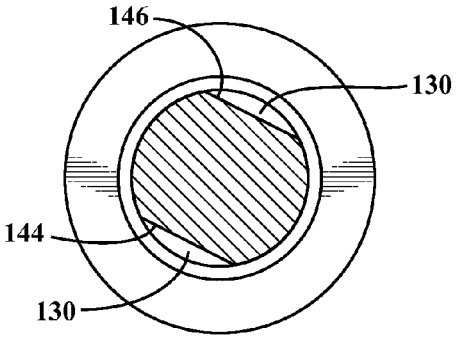
FIG. 5 is a sectional view taken along line 5-5 in FIG. 4.
Figure 6:
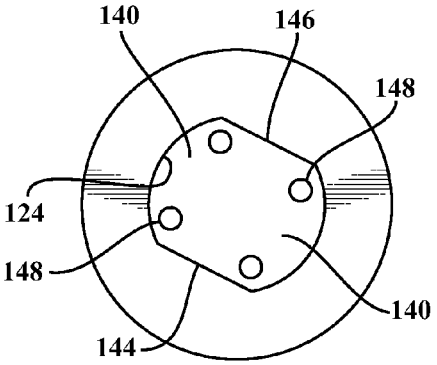
FIG. 6 is an end elevational view of one trunnion member and a center shaft without a retainer disk.
Figure 7:
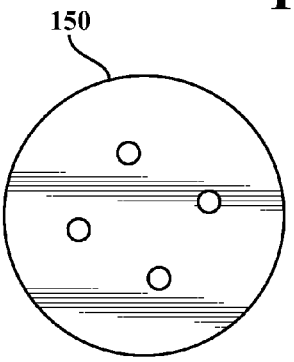
FIG. 7 is an elevational view of a retainer disk.
Figure 8:
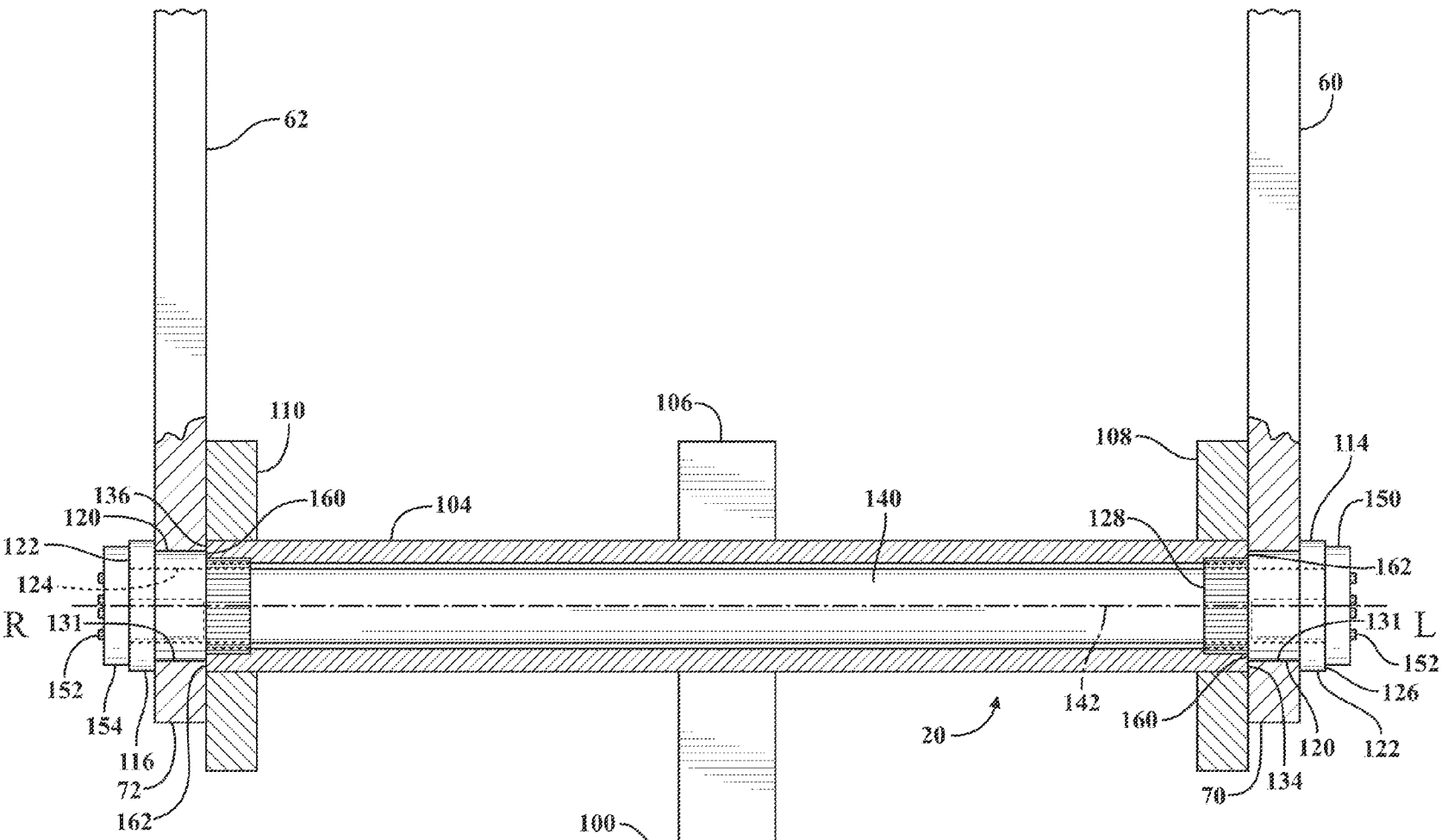
FIG. 8 is a sectional view of a stick connector assembly pivotally connecting a stick to two space apart boom member with parts broken away.

A stick shaft 140 with a stick pivot axis 142 passes through the stick tube 104 the left trunnion 114 and the right trunnion 116. End portions of the stick shaft 140 have recesses 144 and 146 that receive the integral trunnion keys 130 and prevent rotation of the stick shaft 140 relative to the left trunnion 114 and the right trunnion 116. The stick shaft 140 has threaded bores 148 in both ends that are parallel to the stick pivot axis 142. A left retainer plate 150 is secured to the stick shaft 140 by bolts 152 that clamp the retainer plate to an end of the stick shaft 140 and the left trunnion 114. A right retainer plate 154 is secured to the stick shaft 140 by bolts 152 that clamp the retainer plate to an end of the stick shaft 140 and the right trunnion 116. The stick shaft 140 is tensioned to hold the left trunnion 114, the tube 104 of stick assembly 20 and the right trunnion 116 together as one rigid unit. A flat ring shaped surface 160 on the left trunnion 114 is clamped to a tube contact surface 162 on an end of the tube 104 to hold the left trunnion in a position coaxial with the stick pivot axis 142 as shown in FIG. 4. A flat ring shaped surface 160 on the right trunnion 116 is clamped to a tube contact surface 162 on an end of the tube 104 to hold the right trunnion 116 in a position coaxial with the stick pivot axis 142 as shown in FIG. 8.

A free end 70 of the left boom member 60 is journaled on the cylindrical bearing surface 120 of the left trunnion 114. The cylindrical bearing surface 120 on the left trunnion 114 is received in a left boom bore 131 adjacent to the left boom free end 70. The left boom member 60 is axially retained between the tube contact surface 162 on tube 104 and the trunnion end flange 122 on the left trunnion 114. A right free end 72 of the right boom member 62 is journaled on the cylindrical bearing surface 120 of the right trunnion 116. The right boom member 62, is axially retained between the tube contact surface 162 on tube 104 and the trunnion end flange 122 on the right trunnion 116. Axial movement of the stick assembly 20 relative to the boom assembly 18 along the stick pivot axis 142 is limited. Thrust bearings may be added if necessary.

Boom assemblies 18 and stick assemblies 20 for excavating deep trenches require booms and sticks with extended length and strength. It may be necessary to remove the stick assembly 20 from the boom 18 to move from one work site to another work site. The stick shaft 140 has a smaller diameter than the inside diameter of the tube 104 to facilitate removal of the stick assembly 20 from the boom assembly 18. The space between stick shaft 140 and the tube 104 may function as an oil reservoir. The oil would lubricate moving surfaces between the boom members 60 and 62 and the stick assembly 20. The trunnion members 114 and 116 may be removed in a relatively short time with minimal tooling and support equipment. Removal of one trunnion member 114 or 116 will permit removal of the other trunnion member with the stick shaft 140 attached. Removal and replacement of the stick shaft 140 with one trunnion member attached will facilitate removal and attachment of the stick assembly 20. The weight of a combined stick shaft and trunnion member may require a lifting and moving apparatus for attaching the stick assembly 20 to a boom assembly 18.

A left hydraulic cylinder actuator 170, for moving the stick assembly 20 about the stick pivot axis 142, has a left cylinder end 172 attached to the left boom member 60 by a pin 174 and a rod end 176 pivotally attached to the left stick tine 108. A right hydraulic cylinder actuator 180, for moving the stick assembly 20 about the stick pivot axis 142, has a right cylinder end 182 attached to the left boom member 62 by a pin 184 and a rod end 186 pivotally attached to the right stick tine 110. The tube 104, that pivots about the stick pivot axis 142, forces the left actuator 170 and right actuator 180 to work together.

A bucket assembly 22 includes a bucket 190 pivotally attached to the distal end 102 of the stick 100 by a pivot pin 192. A hydraulic cylinder 194 has a cylinder end 196 pivotally attached to the stick portion 100 by a pivot pin 198. A rod end 200 of the hydraulic cylinder 194 is connected to the bucket 190 by a linkage assembly 202. The linkage assembly 202 extends the range of pivotal movement of the bucket 190 about the pivot pin 192.

Figure 3:
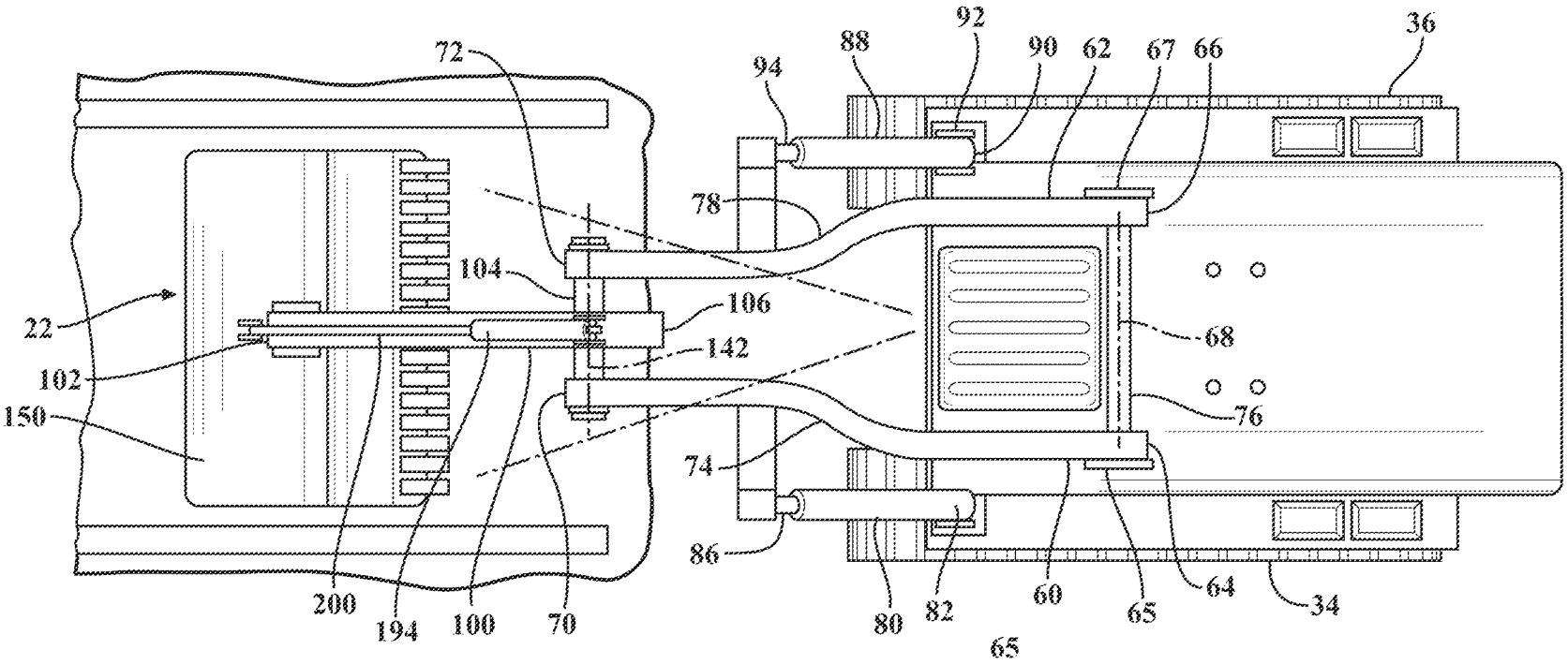
FIG. 3 is a plan view of the excavator adjacent to a trench with a revetment box and parts broken away and the stick tines and stick pivot cylinders removed to show the stick tube.
Figure 9:
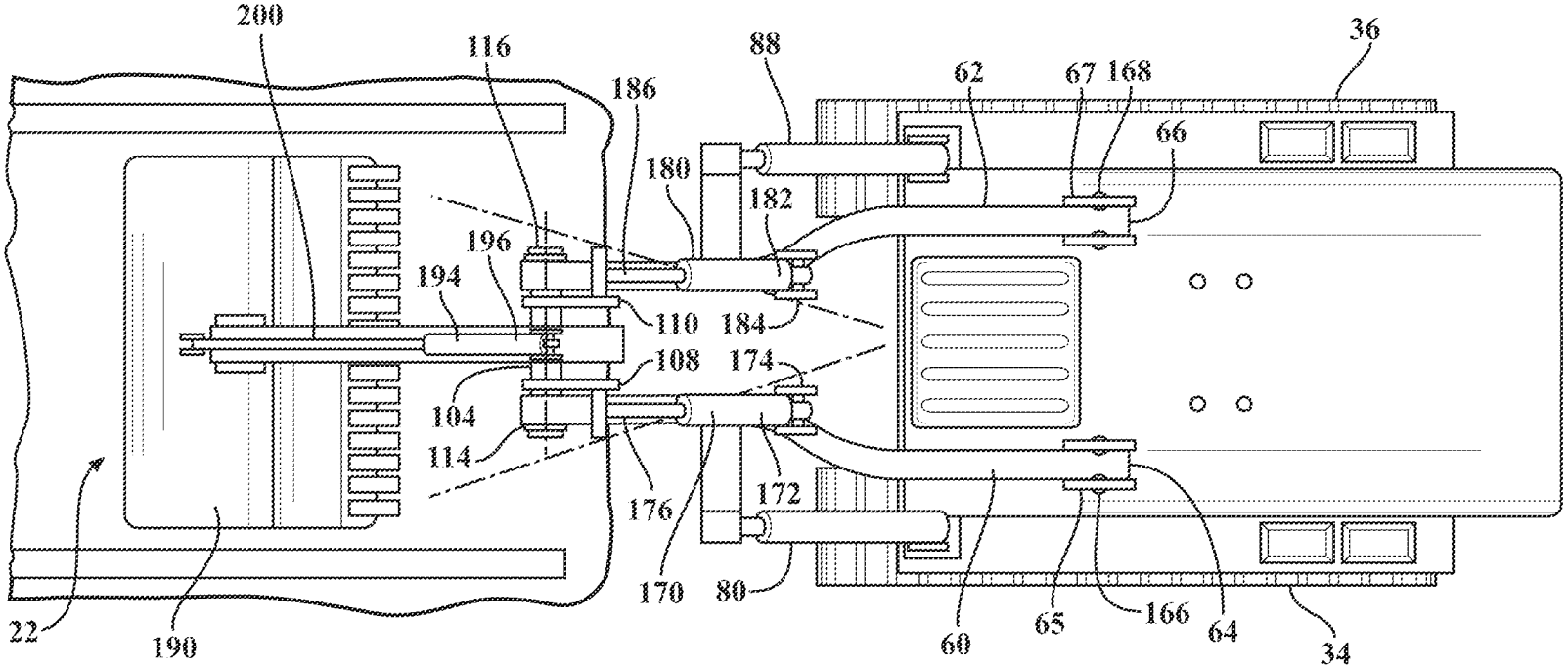
FIG. 9 is a plan view of the excavator adjacent to a trench with a revetment box having parts broken away and two modified boom connections to the upper frame assembly.

The horizontal boom shaft 76, shown in FIG. 3 may be replaced by a separate left boom pin 166 for pivotally securing the left boom 60 to the upper frame assembly 14 and a separate right pin 168 for pivotally securing the right boom 62 to the upper frame assembly as shown in FIG. 9. Two boom pins 166 and 168 with space between them provide room for an excavator operator to enter the operator's compartment 16 through a rear door. Two separate pins 166 and 168 also provide space for items such as hydraulic pumps, oil filters and control valves in the housing 48.

The boom assembly 18 stick assembly 20 as described above permits the operator to look forward and downward or upward and see both ends of the bucket assembly and rear facing surface of the stick assembly in at least most working positions. The position of the operator's enclosure will reduce operator's fatigue, improve safety and increase the work done each hour. The reduced fatigue will also increase the numbers of hours worked by an operator each day.

I claim:

1. A hydraulic excavator comprising:

an undercarriage frame supported by a left continuous track trained around a left front idler roller and a left rear driven sprocket and supported by a right continuous track trained around a right front idler roller and a right rear driven sprocket;

an upper frame assembly rotatably attached to the undercarriage frame for pivotal movement about a vertical axis and including a counter weight attached to a rear portion of the upper frame assembly, an operator's enclosure mounted on a forward portion of the upper frame assembly, a housing mounted on the upper frame assembly between the counter weight and the operator's enclosure;

a boom assembly including a left boom member with a left rear portion including, a left rear end pivotally attached to the upper frame assembly by a left boom pin a left front portion with a left free end and a left transition portion integral with the left rear portion and the left front portion, a right boom member with a right rear portion including a right rear end pivotally attached to the upper frame assembly by a right boom pin, a right front portion with a right free end and a right transition portion integral with the right rear portion and the right front portion and wherein the left transition portion off sets the left front portion to the right of the left rear portion and the right transition portion offsets the right front portion to the left of the right rear portion, the left boom pin and the right boom pin are both coaxial with a boom horizontal axis, positioned near the vertical axis, the left front portion parallel to the right front portion, the left rear portion positioned to the left of the operator's enclosure, and the right rear portion positioned to the right of the operator's enclosure;

a stick assembly including an elongated stick portion with a stick distal end and a stick proximal end, a transverse tube fixed to the stick proximal end, the transverse tube coaxial with a stick pivot axis a left stick tine fixed to the transverse tube adjacent to a left tube end, a right stick tine fixed to the transverse tube adjacent to a right tube end and parallel to the left stick tine;

a left trunnion including a left central trunnion passage extending from a left trunnion outside end surface to a left trunnion inside end surface, a left trunnion end flange including a left cylindrical radially outer surface extending axially relative to the left central trunnion passage from the left trunnion outside end surface to a left radially extending boom retainer surface, a left cylindrical bearing surface extending from the left trunnion end flange toward the left trunnion inside end surface and to a left radially extending ring shaped surface, a left male trunnion spline extending axially between the left radially extending ring shaped surface and the left trunnion inside end surface;

a right trunnion including a right central trunnion passage extending from a right trunnion outside end surface to a right trunnion inside end surface, a right trunnion end flange including a right cylindrical radially outer surface extending axially relative to the right central trunnion passage from the right trunnion outside end surface to a right radially extending boom retainer surface, a right cylindrical bearing surface extending from the right trunnion end flange toward the right trunnion inside end surface and to a right radially extending ring shaped surface, a right male trunnion spline extending axially between the right radially extending ring shaped surface and the right trunnion inside end surface;

a stick shaft with a left end and a right end, a shaft diameter that is substantially the same as a diameter of the left central trunnion passage in the left trunnion and the right central trunnion passage in the right trunnion, a plurality of left threaded bores in the left end, a plurality of right threaded bores in the right end, at least two left side recesses adjacent to the left end, at least two right side recesses adjacent to the right end and extending through the transverse tube;

a left boom bore receiving the left cylindrical bearing surface of the left trunnion, the left central trunnion passage of the left trunnion receiving the left end of the stick shaft and at least two left trunnion keys engage the at least two left side recesses;

a right boom bore receiving the right cylindrical bearing surface of the right trunnion, the right central trunnion passage of the right trunnion receiving the right end of the stick shaft and at least two right trunnion keys engage the at least two right side recesses;

a left retainer plate clamped to the left end of the stick shaft by at least two left bolts and a right retainer plate clamped to the right end of the stick shaft by at least two right retainer bolts that cooperate to hold the left male trunnion spline in engagement with a tube left female spline, to hold the left trunnion radially extending ring shaped surface in engagement with the left tube end, to hold the right male trunnion spline in engagement with a tube right female spline, and to hold the right trunnion radially extending ring shaped surface in engagement with the right tube end;

a left hydraulic boom cylinder includes a left cylinder end pivotally attached to the upper frame assembly and rod end pivotally connected to the left boom member, and a right hydraulic boom cylinder includes a right cylinder end pivotally attached to the upper frame assembly and a rod end pivotally connected to the right boom member and wherein both cylinders pivot the left boom member and the right boom member together about the boom horizontal axis;

a left hydraulic stick actuator includes a left stick cylinder end pivotally attached to the left boom member and a left stick rod end pivotally attached to the left stick tine, and a right hydraulic stick actuator includes a right stick cylinder end pivotally attached to the right boom member and a right stick rod end pivotally attached to the right stick tine, and wherein the left hydraulic stick actuator and the right hydraulic stick actuator both pivot the stick together about a stick pivot axis;

a bucket assembly pivotally attached to the distal end of the stick assembly by a bucket pivot pin; and a hydraulic cylinder including a cylinder end pivotally attached to the elongated stick portion by a pivot pin, and a rod connected to the bucket assembly through a linkage assembly.

2. A hydraulic excavator comprising:

an undercarriage frame supported by a left continuous track trained around a left front idler roller and a left rear driven sprocket and supported by a right continuous track trained around a right front idler roller and a right rear driven sprocket;

an upper frame assembly rotatably attached to the undercarriage frame for pivotal movement about a vertical axis and including a counter weight attached to a rear portion of the upper frame assembly, an operator's enclosure mounted on a forward portion of the upper frame assembly, a housing mounted on the upper frame assembly between the counter weight and the operator's enclosure;

a boom assembly including a boom shaft journaled on the upper frame assembly for pivotal movement about a boom horizontal axis positioned near the vertical axis and transverse to the upper frame assembly, a left boom member with a left rear portion including, a left rear end fixed to the boom shaft, a left front portion with a left free end and a left transition portion integral with the left rear portion and the left front portion, a right boom member with a rear portion including a right rear end fixed to the boom shaft, a right front portion with a right free end and a right transition portion integral with the right rear portion and the right front portion and wherein the left transition portion off sets the left front portion to the right of the left rear portion and the right transition portion offsets the right front portion to the left of the right rear portion, the left front portion parallel to the right front portion, the left rear portion positioned to the left of the operator's enclosure, and the right rear portion positioned to the right of the operator's enclosure;

a stick assembly including an elongated stick portion with a stick distal end and a stick proximal end, a transverse tube fixed to the stick proximal end, the transverse tube coaxial with a stick pivot axis a left stick tine fixed to the transverse tube adjacent to a left tube end, a right stick tine fixed to the transverse tube adjacent to a right tube end and parallel to the left stick tine;

a left trunnion including a left central trunnion passage extending from a left trunnion outside end surface to a left trunnion inside end surface, a left trunnion end flange including a left radially extending boom retainer surface, a left cylindrical bearing surface extending from the left trunnion end flange to a left radially extending ring shaped surface, a left male trunnion spline extending axially between the left radially extending ring shaped surface and the left trunnion inside end surface;

a right trunnion including a right central trunnion passage extending from a right trunnion outside end surface to a right trunnion inside end surface, a right trunnion end flange including a right radially extending boom retainer surface, a right cylindrical bearing surface extending from the right trunnion end flange to a right radially extending ring shaped surface, a right male trunnion spline extending axially between the right radially extending ring shaped surface and the right trunnion inside end surface;

a stick shaft with a left end and a right end, a shaft diameter that is substantially the same as a diameter of the left central trunnion passage in the left trunnion and the right central trunnion passage in the right trunnion, a plurality of left threaded bores in the left end, a plurality of right threaded bores in the right end, at least two left side recesses adjacent to the left end, at least two right side recesses adjacent to the right end and extending through the transverse tube;

a left boom bore receiving the left cylindrical bearing surface of the left trunnion, the left central trunnion passage of the left trunnion receiving the left end of the stick shaft and at least two left trunnion keys engage the at least two left side recesses;

a right boom bore receiving the right cylindrical bearing surface of the right trunnion, the right central trunnion passage of the right trunnion receiving the right end of the stick shaft and at least two right trunnion keys engage the at least two right side recesses;

a left retainer plate clamped to the left end of the stick shaft by at least two left bolts and a right retainer plate clamped to the right end of the stick shaft by at least two right retainer bolts that cooperate to hold the left male trunnion spline in engagement with a tube left female spline, to hold the left trunnion radially extending ring shaped surface in engagement with the left tube end, to hold the right male trunnion spline in engagement with a tube right female spline, to hold the right trunnion radially extending ring shaped surface in engagement with the right tube end and wherein the stick shaft, the left trunnion and the right trunnion are fixed to the transverse tube of the stick assembly;

a left hydraulic boom cylinder includes a left cylinder end pivotally attached to the upper frame assembly and rod end pivotally connected to the left boom member, and a right hydraulic boom cylinder includes a right cylinder end pivotally attached to the upper frame assembly and a rod end pivotally connected to the right boom member and wherein both cylinders pivot the left boom member and the right boom member together about the boom horizontal axis;

a left hydraulic stick actuator includes a left stick cylinder end pivotally attached to the left boom member and a left stick rod end pivotally attached to the left stick tine, and a right hydraulic stick actuator includes a right stick cylinder end pivotally attached to the right boom member and a right stick rod end pivotally attached to the right stick tine, and wherein the left hydraulic stick actuator and the right hydraulic stick actuator both pivot the stick assembly together about the stick pivot axis;

a bucket assembly pivotally attached to the distal end of the stick assembly by a bucket pivot pin; and a hydraulic cylinder including a cylinder end pivotally attached to the elongated stick portion by a pivot pin, and a rod connected to the bucket assembly through a linkage assembly.

3. A hydraulic excavator comprising:

an undercarriage frame supported by a left continuous track trained around a left front idler roller and a left rear driven sprocket and supported by a right continuous track trained around a right front idler roller and a right rear driven sprocket;

an upper frame assembly rotatably attached to the undercarriage frame for pivotal movement about a vertical axis and including a counter weight attached to a rear portion of the upper frame assembly, an operator's enclosure mounted on a forward portion of the upper frame assembly, a housing mounted on the upper frame assembly between the counter weight and the operator's enclosure;

a boom assembly including a left boom shaft journaled on the upper frame assembly for pivotal movement about a boom horizontal axis positioned near the vertical axis and transverse to the upper frame assembly, a left boom member with a left rear portion including, a left rear end fixed to the boom shaft, a left front portion with a left free end and a left transition portion integral with the left rear portion and the left front portion, a right boom member with a rear portion including a right rear end fixed to the boom shaft, a right front portion with a right free end and a right transition portion integral with the right rear portion and the right front portion and wherein the left transition portion off sets the left front portion to the right of the left rear portion and the right transition portion offsets the right front portion to the left of the right rear portion, the left front portion parallel to the right front portion, the left rear portion positioned to the left of the operator's enclosure, and the right rear portion positioned to the right of the operator's enclosure;

a stick assembly including an elongated stick portion with a stick distal end and a stick proximal end, a transverse tube fixed to the stick proximal end, the transverse tube coaxial with a stick pivot axis a left stick tine fixed to the transverse tube adjacent to a left tube end, a right stick tine fixed to the transverse tube adjacent to a right tube end and parallel to the left stick tine;

a left trunnion including a left central trunnion passage extending from a left trunnion outside end surface to a left trunnion inside end surface, a left trunnion end flange including a left cylindrical radially outer surface extending axially relative to the left central trunnion passage from the left trunnion outside end surface to a left radially extending boom retainer surface, a left cylindrical bearing surface extending from the left trunnion end flange toward the left trunnion inside end surface and to a left radially extending ring shaped surface, a left male trunnion spline extending axially between the left radially extending ring shaped surface and the left trunnion inside end surface;

a right trunnion including a right central trunnion passage extending from a right trunnion outside end surface to a right trunnion inside end surface, a right trunnion end flange including a right cylindrical radially outer surface extending axially relative to the right central trunnion passage from the right trunnion outside end surface to a right radially extending boom retainer surface, a right cylindrical bearing surface extending from the right trunnion end flange toward the right trunnion inside end surface and to a right radially extending ring shaped surface, a right male trunnion spline extending axially between the right radially extending ring shaped surface and the right trunnion inside end surface;

a stick shaft with a left end and a right end, a shaft diameter that is substantially the same as a diameter of the left central trunnion passage in the left trunnion and the right central trunnion passage in the right trunnion, a plurality of left threaded bores in the left end, a plurality of right threaded bores in the right end, at least two left side recesses adjacent to the left end, at least two right side recesses adjacent to the right end and wherein the stick shaft extends through the transverse tube;

a left boom bore receives the left cylindrical bearing surface of the left trunnion, the left central trunnion passage of the left trunnion receives the left end of the stick shaft and a pair of left trunnion keys engage the at least two left side recesses;

a right boom bore receives the right cylindrical bearing surface of the right trunnion, the right central trunnion passage of the right trunnion receives the right end of the stick shaft and a pair of right trunnion keys engage the at least two right side recesses;

a left retainer plate clamped to the left end of the stick shaft by a pair of left bolts and a right retainer plate clamped to the right end of the stick shaft by a pair of right retainer bolts that cooperate to hold the left male trunnion spline in engagement with a tube left female spline, to hold the left trunnion radially extending ring shaped surface in engagement with the left tube end, to hold the right male trunnion spline in engagement with a tube right female spline, to hold the right trunnion radially extending ring shaped surface in engagement with the right tube end;

a left hydraulic boom cylinder includes a left cylinder end pivotally attached to the upper frame assembly and rod end pivotally connected to the left boom member, and a right hydraulic boom cylinder includes a right cylinder end pivotally attached to the upper frame assembly and a rod end pivotally connected to the right boom member and wherein both cylinders pivot the left boom member and the right boom member together about the boom horizontal axis;

a left hydraulic stick actuator includes a left stick cylinder end pivotally attached to the left boom member and a left stick rod end pivotally attached to the left stick tine, and a right hydraulic stick actuator includes a right stick cylinder end pivotally attached to the right boom member and a right stick rod end pivotally attached to the right stick tine, and wherein the left hydraulic stick actuator and the right hydraulic stick actuator both pivot the stick assembly together about the stick pivot axis;

a bucket assembly pivotally attached to the distal end of the stick assembly by a bucket pivot pin; and a hydraulic cylinder including a cylinder end pivotally attached to the elongated stick portion by a pivot pin, and a rod connected to the bucket assembly through a linkage assembly.

4. The hydraulic excavator as set forth in claim 3, including a lubricant chamber inside the transverse tube of the stick assembly between the left trunnion inside end surface and the right trunnion inside end surface.

* * * * *